US005231740A

United States Patent [19]

Mohebkhosravi

[11] Patent Number: 5,231,740

[45] Date of Patent: Aug. 3, 1993

[54] SAFETY CLASP FOR JEWELRY

[76] Inventor: Mohammad M. Mohebkhosravi, 8337 S. 75th East Ave., Tulsa, Okla. 74133

[21] Appl. No.: 912,296

[22] Filed: Jul. 13, 1992

[51] Int. Cl.[5] ..... A44B 11/26

[52] U.S. Cl. ..... 24/616; 24/589

[58] Field of Search ..... 24/614, 615, 616, 589, 24/583

[56] References Cited

U.S. PATENT DOCUMENTS

| | | | |
|---|---|---|---|
| 812,661 | 2/1906 | Luckhaupt | 24/583 |
| 833,458 | 10/1906 | Hausherr | 24/583 |
| 889,230 | 6/1908 | Hoffman | 24/616 |
| 1,141,575 | 6/1915 | Naylor . | |
| 1,238,495 | 8/1917 | Christ | 24/616 |
| 3,092,885 | 6/1963 | Guanche . | |
| 3,308,517 | 3/1967 | Geldwerth . | |
| 3,947,932 | 4/1976 | Flynn | 24/616 |
| 4,170,809 | 10/1979 | Geldwerth . | |
| 4,426,854 | 1/1984 | Geldwerth . | |
| 4,520,537 | 6/1985 | Valikov . | |
| 4,527,316 | 7/1985 | Murphy . | |
| 4,530,221 | 7/1985 | Weinberg . | |
| 4,543,692 | 10/1985 | Ode . | |

FOREIGN PATENT DOCUMENTS

| | | | |
|---|---|---|---|
| 686243 | 3/1965 | Italy | 24/616 |
| 16537 | 8/1908 | United Kingdom | 24/616 |

*Primary Examiner*—James R. Brittain

*Attorney, Agent, or Firm*—Head & Johnson

[57] ABSTRACT

A safety clasp for jewelry including a receptacle having a cavity and a pair of opposed shoulders extending into the cavity. A leaf spring, which is insertable into the receptacle, includes a pair of legs in angular relation with each other. A first or primary clasp mechanism is provided to engage the leaf spring with the receptacle wherein a first leg terminates in a free end which will engage the opposed shoulders. An additional clasp mechanism is provided in the event of failure or unfastening of the primary clasp. A pair of inwardly extending recesses are provided in the first leg, the recesses being spaced from the end to form a pair of fins in order to engage the opposed shoulders.

7 Claims, 3 Drawing Sheets

SAFETY CLASP FOR JEWELRY

BACKGROUND OF THE INVENTION

1. Field of the Invention

The present invention relates to a safety clasp for jewelry chains or the like. In particular, the present invention relates to a safety clasp for jewelry chains or the like wherein an additional, safety mechanism will prevent the clasp from becoming unfastened in the event that the primary mechanism fails or is unfastened.

2. Prior Art

Safety clasps for jewelry chains are well known and come in a few standard varieties. Typically, a male or tongue portion is received within a barrel or female portion. The tongue portion has a leaf spring providing a force to separate a pair of legs. The barrel portion will have a cavity and a shoulder or shoulders near the opening of the cavity.

In order to fasten the clasp, the tongue portion of the clasp will be inserted in the barrel while the legs are compressed or squeezed together. When the tongue portion is inserted fully, a free end of the leg will move past the shoulders. When the legs are released the leg of the tongue will be forced against the interior of the barrel and will not be able to be withdrawn past the shoulders until the legs or leafs are pressed together again and withdrawn. Various prior patents disclose variations on these typical jewelry clasps.

Valikov (U.S. Pat. No. 4,520,537) discloses a jewelry clasp which includes a keeper or barrel for receiving a folded spring tongue. The tongue has a pair of ledges or recesses to catch on the barrel when inserted therein.

Ode (U.S. Pat. No. 4,543,692) discloses a two-part clasp body and engaging member. The engaging member is a leaf spring which has a transverse slot across the leaf spring.

Guanche (U.S. Pat. No. 3,092,885) discloses a safety clasp comprising a catch plate, a latch to be engaged and disengaged from the catch plate. The tongue has a pair of recesses to catch on the barrel.

Geldwerth (U.S. Pat. No. 3,308,517) discloses a keeper with a top recess for receiving a catch which has an actuating pin.

Geldwerth (U.S. Pat. No. 4,170,809) discloses a jewelry clasp comprising a barrel and a spring clip with an upstanding top protrusion. The spring clip is inserted into the barrel and is engaged by the clip's protrusion.

Geldwerth (U.S. Pat. No. 4,426,854) discloses an example of a cylindrical jewelry clasp. A barrel with a retainer clip and a recess receives a male member having a spring clip with an upper protrusion and a side pin. An external secondary or supplemental clasp is provided as a safety mechanism. While the external secondary clasps are functional, they require significant additional manipulation as well as additional gold and manufacturing time.

It has been found that the primary clasp may become disengaged for a number of reasons. The clasp may become stuck on clothing so that the legs are accidentally compressed and the tongue is withdrawn. Additionally, the tongue may not have been fully inserted initially so that the primary safety clasp mechanism is not engaged.

Although the idea of an additional or secondary clasp mechanism has been employed, there has been no suggestion of an additional secondary safety clasp mechanism which is a part of the primary tongue or leaf spring and will act in the event of failure or unfastening of the primary safety clasp.

Accordingly, the present invention is directed to a clasp for a jewelry chain or the like having a leaf spring insertable into a barrel and which includes a primary clasp mechanism along with a secondary clasp mechanism, both of which are formed from the leaf spring itself.

It is a further object and purpose of the present invention to provide a clasp for a jewelry chain or the like wherein the secondary clasp mechanism will only be activated in the event of failure or unfastening of the primary clasp mechanism.

SUMMARY OF THE INVENTION

A safety clasp for jewelry of the present invention includes a tongue or male member which is insertable within a barrel or receptacle. The receptacle is substantially open at one end and has an open interior so as to form a cavity. Extending from the receptacle at the open end is a pair of opposed shoulders.

The tongue includes a leaf spring having a first leg and a second leg connected together at one end so that the legs are in angular relation with each other. The end of the legs is insertable into the cavity. If the legs are squeezed or compressed together, a resilient, spring force urges the legs to their original position.

The first leg terminates in a free end. The free end includes a pair of lateral edges near or at the free end of the first leg. When the end of the legs is inserted into the cavity, the first leg and second leg will be held by the user and compressed or squeezed together. Once the tongue has been fully inserted into the cavity, the lateral edges of the free end will be inserted past the opposed shoulders so that they are within the receptacle.

Thereafter, the legs of the tongue will be released. The resilient, spring action of the tongue will urge the free end away from the second leg and back toward the original position. The lateral edges will be within the cavity on the interior side of the opposed shoulders. Accordingly, the tongue may not be withdrawn from the receptacle until the legs are again compressed or squeezed together.

An additional or secondary safety mechanism is employed in the present invention which operates in the case of failure or unfastening of the primary clasp mechanism. A pair of slots or inwardly extending recesses are provided on opposed sides of the first leg. The slots are spaced from the free end a slight distance. The slots in the leg thereby form a pair of transverse fins.

If for any reason, the lateral edges of the free end become disengaged from the shoulders of the receptacle, the tongue may begin to withdraw from the receptacle. In that event, the spring action or tension of the legs urges the first leg against the receptacle. The fins formed by the slots will engage with or catch against the opposed shoulders. Accordingly, the tongue may only be withdrawn a short distance out of the receptacle and will not become disengaged therefrom.

DETAILED DESCRIPTION OF THE PREFERRED EMBODIMENT

Figure 1:
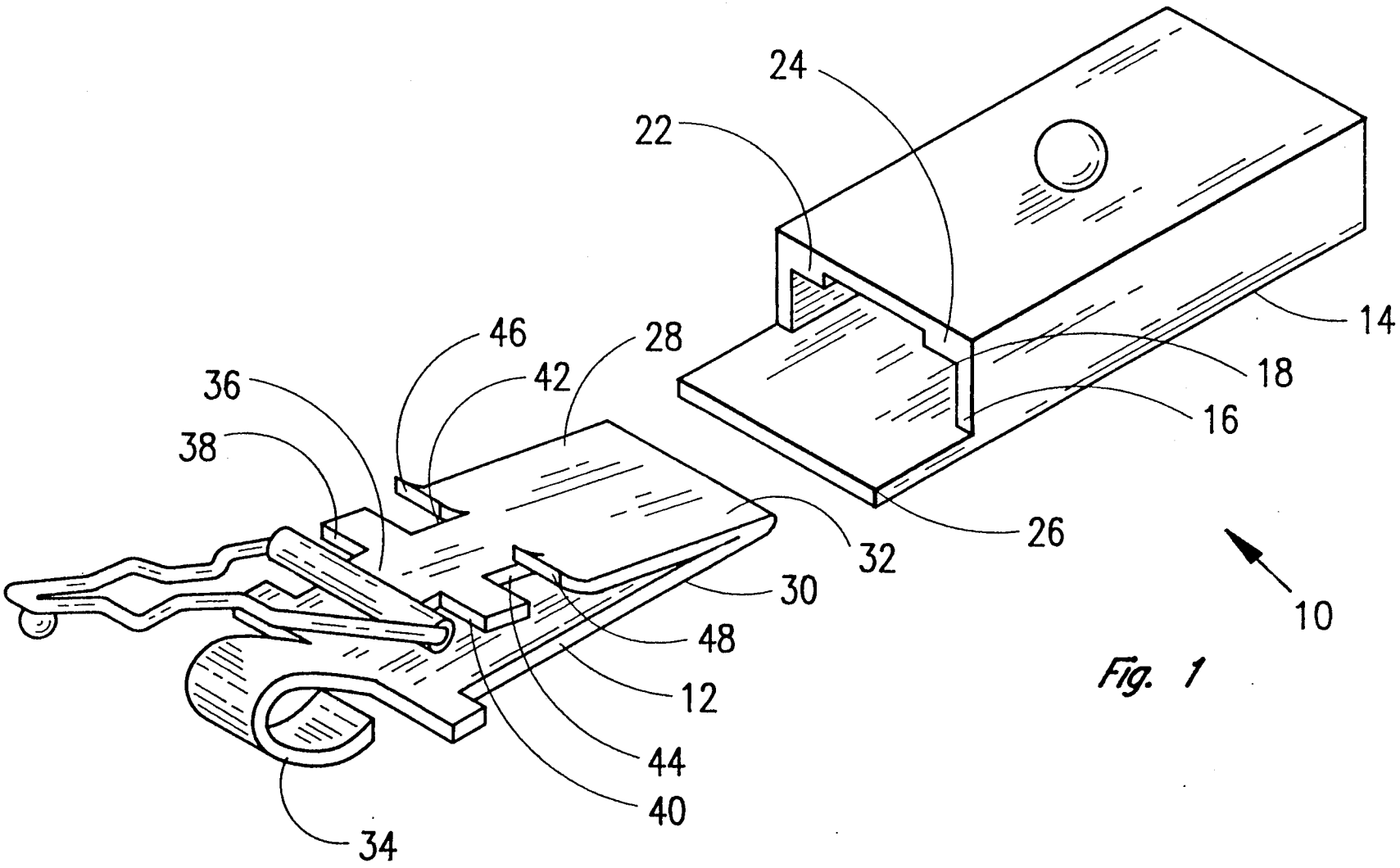
FIG. 1 is a perspective view of a safety clasp of the present invention wherein a tongue and a barrel of the clasp are separated from each other.

Referring to the drawings in detail, FIG. 1 illustrates a perspective view of a safety clasp 10 for jewelry. A tongue or male member 12 is shown separated and apart from a barrel or receptacle 14.

The receptacle in the present embodiment is in the shape or design of a rectangular prism. Receptacle 14 is substantially open at one end 16. The receptacle has an open interior so as to form a cavity 18. Extending from the receptacle at the open end 16 is a pair of opposed shoulders 22 and 24. The opposed shoulders extend partially across the cavity 18.

An optional extending guide 26 acts to assist in the insertion of the tongue into the receptacle.

Although the receptacle is in the shape of a rectangular prism in the embodiment shown in FIG. 1, it will be understood that the receptacle may take other designs, such as cubes or other forms.

The tongue 12 includes a leaf spring having a first leg 28 and a second leg 30. The legs 28 and 30 are connected together at one joined end 32 and are in angular relation with each other. The joined end 32 of the legs is insertable into the cavity 18.

The tongue may be fabricated from a flat piece of forged metal such as gold so that if leg 28 and leg 30 are squeezed together, a spring force or tension will urge the legs back to their original position in angular relation to each other.

The tongue 12 may include a hook 34 or other device to secure one end of a jewelry chain (not shown). Likewise, the receptacle 14 may include a hook or other device (not shown) to secure the opposite end of the chain (not shown).

The first leg 28 terminates in a free end 36. Opposite the joined end 32. The free end 36 includes a pair of lateral edges 38 and 40 near or at the free end 36 of the leg 28.

When the tongue 12 is inserted by the user into the cavity 18 of the receptacle 14, the joined end 32 will be inserted into the cavity initially. The first leg 28 and second leg 30 will be held by the user (not shown) and compressed toward each other so that the tongue will easily fit within the cavity. When the legs are compressed or squeezed together, they will be more nearly parallel than the position at rest shown in FIG. 1.

Once the lateral edges 38 and 40 have been inserted past the opposed shoulders 22 and 24 of the receptacle, the legs of the tongue will be released. The spring action of the tongue will urge the free end 36 away from the second leg 30 back toward their original position. The lateral edges will then be within the cavity and on the interior side of the opposed shoulders 22 and 24. Accordingly, the tongue may not be withdrawn from the receptacle until the legs are compressed or squeezed together again. The foregoing forms the primary clasp mechanism.

In the present invention, an additional or secondary safety mechanism is also employed. The secondary safety mechanism only operates in the event of failure or unfastening of the primary clasp mechanism. A pair of slots or inwardly extending recesses 42 and 44 are provided on opposed sides of the first leg. The slots 42 and 44 are spaced from the free end 36 a slight distance. The slots in the leg thereby form a pair of transverse fins 46 and 48.

The fins are substantially parallel with the lateral edges.

If the lateral edges 38 and 40 become disengaged from the shoulders 22 and 24 of the receptacle for any reason, the tongue 12 may begin to withdraw from the receptacle. In that case, the spring action or tension of the legs will urge the first leg 28 away from the second leg and against the receptacle. If the tongue continues to withdraw, the fins 46 and 48 will engage with or catch against the opposed shoulders 22 and 24. Accordingly, the tongue 12 may only be withdrawn a short distance out of the receptacle and will not become disengaged therefrom.

Figures 2, 3:
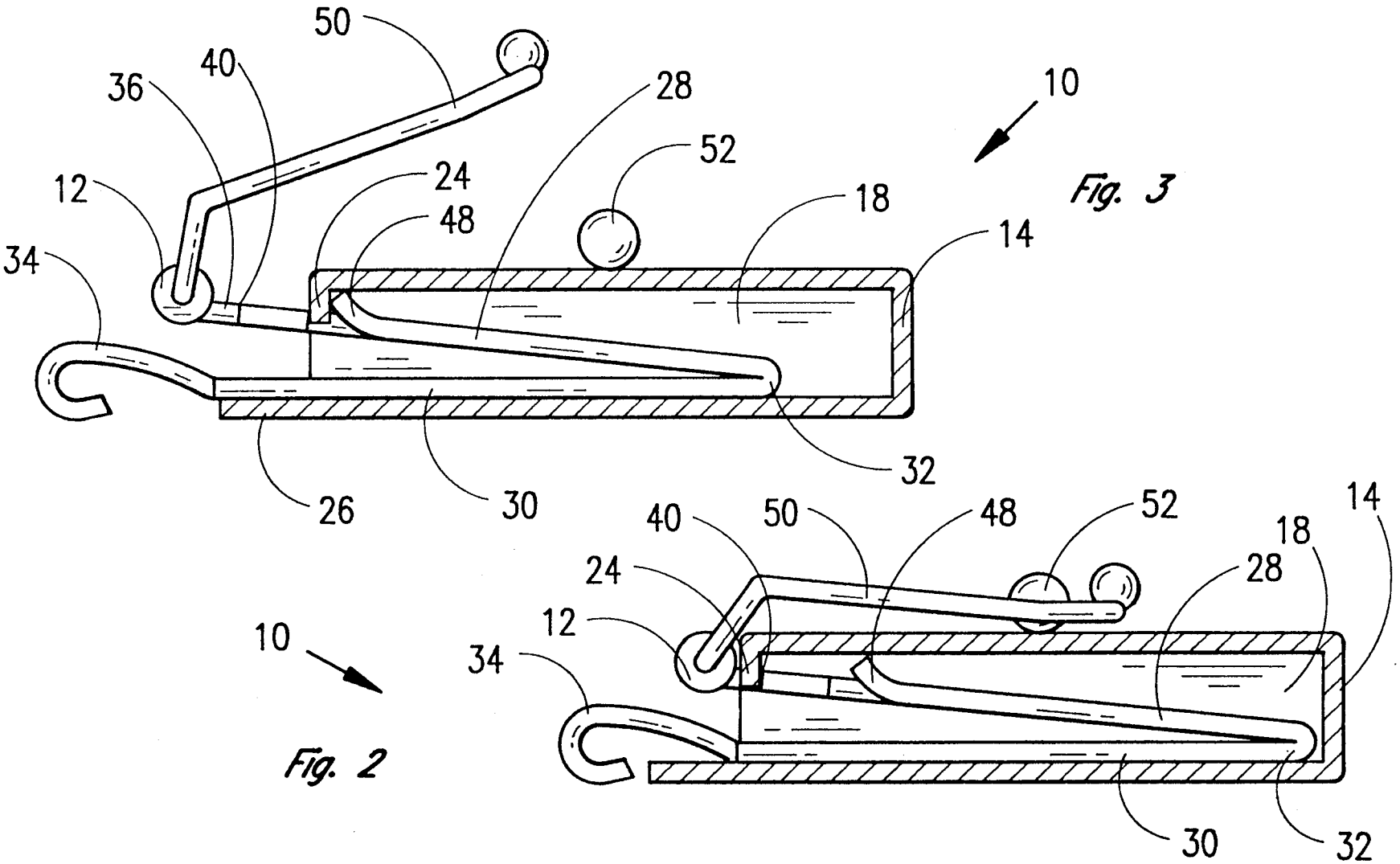
FIG. 2 is a sectional view of the safety clasp shown in FIG. 1 with the tongue inserted fully within the barrel.
FIG. 3 is a sectional view of the safety clasp shown in FIG. 2 wherein the tongue has been withdrawn slightly from the barrel so that the secondary safety mechanism is employed.

FIG. 2 illustrates a sectional view of the safety clasp 10 shown in FIG. 1. The tongue 12 has been inserted fully into the receptacle 14. In the position shown, the legs are compressed together slightly. The first leg 28 is shown within the receptacle so that the lateral edge 40 abuts and is engaged with the interior of opposed shoulder 24. Although not visible, the lateral edge 38 also abuts and is engaged with the interior of opposed shoulder 22. In the position shown in FIG. 2, the secondary clasp mechanism is neither needed nor operational.

FIG. 3 illustrates the use of the secondary safety mechanism. If the lateral edges 38 and 40 of the free end 36 become disengaged for any reason from the opposed shoulders, the tongue may begin to withdraw from the receptacle 14. In that case, the resilient, spring force or tension of the legs will cause the first leg to separate from the second leg. The transverse fins 46 and 48 will engage with the opposed shoulders as clearly seen in FIG. 3. Accordingly, the tongue will be prevented from disengaging from the receptacle.

As best seen in FIGS. 2 and 3, the transverse fins may be bent slightly upward and away from the legs 28 and 30 in order to more easily and effectively engage the opposed shoulders.

The safety clasp 10 in the embodiment shown in FIGS. 1, 2 and 3 also includes a safety snap 50 on the tongue and the protruding pin 52 on the receptacle. While the snap and pin are no longer necessary with the present invention, it will be seen that the invention may be employed with this type of known design. FIG. 2 shows the snap engaged with the pin while FIGS. 1 and 3 show the unfastened position.

It will be observed that the secondary safety clasp mechanism requires no additional parts and may be fabricated by simply modifying the primary clasp mechanism.

In order to completely disengage the tongue from the receptacle from the position shown in FIG. 3, the legs will be compressed or squeezed together again and the tongue withdrawn.

Figure 4:
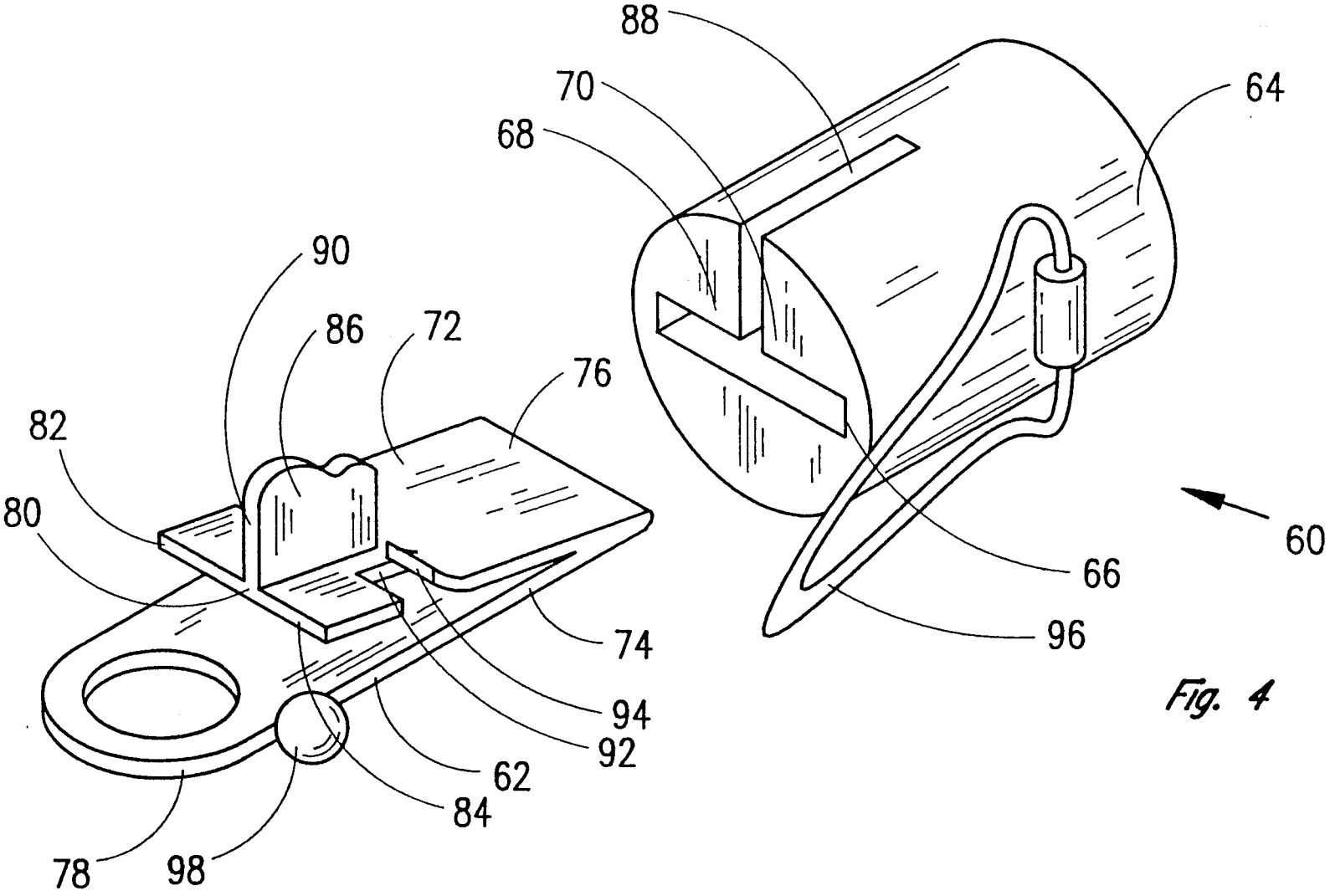
FIG. 4 is a perspective view of an alternate embodiment of the safety clasp of the present invention.

FIG. 4 illustrates a perspective view of an alternate embodiment of a safety clasp 60. A tongue or male member 62 is illustrated separated and removed from a barrel or receptacle 64.

The receptacle 64 is substantially cylindrical and a cavity extends axially into the receptacle 64.

The receptacle has an opening 66 at one end. Extending partially across the opening 66 are a pair of opposed shoulders 68 and 70.

The tongue 62 includes a leaf spring having a first leg 72 and a second leg 74 which are connected together at a joined end 76. As seen in FIG. 4, the legs are in angular relation with each other. The joined end 76 of the legs is insertable into the opening 66 of the receptacle. When the leg 72 and 74 are squeezed or compressed together by a user, a spring force will urge the legs back to their original position.

The tongue 62 includes a ring 78 or other device to secure to an end of the chain (not shown). The receptacle will also include a ring or hook or other device to secure the opposite end of the chain (not shown).

The first leg 72 terminates in a free end 80 opposite the joined end. The free end includes a pair of lateral edges 82 and 84 at or substantially near the free end of the first leg.

When the tongue 6 is to be inserted into the cavity of the receptacle 64, the joined end 76 will be inserted. The first leg 72 and the second leg 74 will be held by the user (not shown) and compressed or squeezed together so that the tongue will easily fit within the opening 66.

Once the lateral edges 82 and 84 have been inserted past the opposed shoulders 68 and 70, respectively, the legs 72 and 74 of the tongue will be released. The resilient, spring action or tension of the legs will urge the free end 80 of the first leg away from the second leg. Accordingly, the legs will tend to move back toward their original position. The lateral edges 82 and 84 will be within the cavity on the interior side of the opposed shoulders 68 and 70. The tongue, therefore, may not be withdrawn from the receptacle until the legs are again compressed or squeezed together.

The first leg also includes a perpendicular protrusion 86 which is receivable within an opening 88 perpendicular to the opening 66.

An additional or secondary safety clasp mechanism is employed and operates in the event of a failure or unfastening of the primary clasp mechanism as described above. A pair of slots or inwardly extending recesses 90 and 92 are provided on opposed sides of the first legs 72. The slots 90 and 92 are spaced from the free end 80. The slots in the first leg thereby form a pair of transverse fins 94 (only one visible in FIG. 4).

If the lateral edges 82 and 84 become disengaged from the shoulders 68 and 70 of the receptacle, the tongue may begin to withdraw from the receptacle. In that case, the resilient, spring action or tension of the legs will urge the first leg 72 against the interior of the receptacle. The fins 94 will engage with or catch against the opposed shoulders 68 and 70. Accordinqly, the tongue 62 may only be withdrawn a short distance from the receptacle and will not become disengaged therefrom.

The embodiment of the clasp 60 shown in FIG. 4 also shows the optional snap 96 and pin 98.

It has been found that the invention provides a secondary or back-up safety mechanism in the event of unfastening or failure of the primary safety clasp mechanism. The safety clasp of the present invention is simple to construct and may be utilized with existing designs of jewelry chain clasps.

Whereas, the present invention has been described in relation to the drawings attached hereto, it should be understood that other and further modifications, apart from those shown or suggested herein, may be made within the spirit and scope of this invention.

I claim:

1. A safety clasp for jewelry which comprises:

an elongated receptacle having a cavity extending from an opening into said receptacle and a pair of opposed shoulders near said opening;

a leaf spring having a first and second leg, said legs joined at one end and extending therefrom in angular relation to each other, said leaf spring receivable in said cavity when said legs are squeezed together;

primary means to engage said leaf spring with said receptacle wherein said first leg terminates in a free end having a pair of lateral edges which will engage said opposed shoulders after said leaf spring is inserted in said cavity; and secondary means to engage said leaf spring with said receptacle including a pair of opposed, inwardly recessed slots in said first leg, said opposed slots juxtaposed between said joined end and said free end and spaced from said free end to form a pair of transverse fins substantially parallel with said lateral edges to engage said opposed shoulders.

2. A safety clasp for jewelry as set forth in claim 1 wherein each said fin will be bent away from said first and second legs.

3. A safety clasp for jewelry as set forth in claim 1 wherein said receptacle is cylindrical and said cavity extends axially into said receptacle.

4. A safety clasp for jewelry as set forth in claim 1 wherein said receptacle is a rectangular prism and said cavity extends into said receptacle from one of said walls.

5. A safety clasp for jewelry as set forth in claim 1 wherein said secondary means may engage said leaf spring with said receptacle only when said primary means is not engaged.

6. A safety clasp for jewelry which comprises:

a receptacle having a cavity and a pair of opposed shoulders extending into said cavity;

leaf spring means having a first and second leg, said legs joined at one end and extending therefrom in angular relation to each other, said leaf spring means insertable into said receptacle when said legs are squeezed together;

means to engage said leaf spring means with said receptacle, wherein said first leg terminates in a free end having a pair of lateral edges which will engage said opposed shoulders after said leaf spring is inserted in said cavity; and an additional means to engage said leaf spring means with said receptacle including a pair of opposed, inwardly extending recesses in said first leg, said recesses juxtaposed between said joined end and said free end and spaced from said free end to form a pair of transverse fins substantially parallel with said lateral edges to engage said opposed shoulders.

7. A safety clasp for jewelry as set forth in claim 6 wherein each of said fins will be bent away from said legs.

* * * * *